US011284695B2

(12) United States Patent
Wang et al.

(10) Patent No.: US 11,284,695 B2
(45) Date of Patent: Mar. 29, 2022

(54) FIVE-IN-ONE POLISHING HEAD

(71) Applicant: SHANGHAI WELL-SUN PRECISION TOOLS CO., LTD., Shanghai (CN)

(72) Inventors: Jishun Wang, Shanghai (CN); Mengyi Wang, Shanghai (CN); Jing Sun, Shanghai (CN)

(73) Assignee: SHANGHAI WELL-SUN PRECISION TOOLS CO., LTD., Shanghai (CN)

( * ) Notice: Subject to any disclaimer, the term of this patent is extended or adjusted under 35 U.S.C. 154(b) by 0 days.

(21) Appl. No.: 17/287,360

(22) PCT Filed: Feb. 22, 2019

(86) PCT No.: PCT/CN2019/075809

§ 371 (c)(1),
(2) Date: Apr. 21, 2021

(87) PCT Pub. No.: WO2020/168534

PCT Pub. Date: Aug. 27, 2020

(65) Prior Publication Data

US 2021/0368959 A1 Dec. 2, 2021

(51) Int. Cl.
*A45D 29/14* (2006.01)
*A45D 29/05* (2006.01)

(52) U.S. Cl.
CPC ..... *A45D 29/14* (2013.01); *A45D 29/05* (2013.01)

(58) Field of Classification Search
CPC ..... A61B 17/54; A61B 17/545; A45D 2029/045; A45D 29/14; A45D 29/12;
(Continued)

(56) References Cited

U.S. PATENT DOCUMENTS 3,916,920 A 11/1975 Sakichi
2008/0223385 A1* 9/2008 Cha ..... A45D 29/04 132/76.4

(Continued)

FOREIGN PATENT DOCUMENTS

CN 2392418 Y 8/2000
CN 101332010 A 12/2008

(Continued)

*Primary Examiner* — Yogesh P Patel
*Assistant Examiner* — Jennifer Gill
(74) *Attorney, Agent, or Firm* — Global IP Services; Tianhua Gu

(57) ABSTRACT

A five-in-one polishing head includes a blade portion and a handle portion. The blade portion is shaped like a cone having a concave or planar top end. Angle teeth, thin teeth, medium-thin teeth, and thick teeth are sequentially distributed in a conical polishing head according to the tooth density. The angle teeth are located at the top of the conical polishing head in a circle. The thick teeth are located at the end of the blade portion. The center of the end of the blade portion is axially welded and fixed to one end of the handle portion. The conical polishing head is provided with regularly distributed straight lines or oblique lines on a surface from the angle teeth to the thick teeth. The shape of a right-handed groove on the surface is inverted trapezoidal, and the shape of a left-handed groove is triangular.

4 Claims, 1 Drawing Sheet

(58) Field of Classification Search
CPC ..... A45D 29/06; B24D 5/14; B24D 5/066; B24D 5/06; B24D 5/02; B24B 23/02
See application file for complete search history.

(56) References Cited

U.S. PATENT DOCUMENTS

| | | | | |
|---|---|---|---|---|
| 2011/0114105 | A1* | 5/2011 | Wazlavek | A45D 29/04 132/76.4 |
| 2014/0212234 | A1* | 7/2014 | Sawabe | B23B 51/00 408/1 R |
| 2015/0150353 | A1* | 6/2015 | Yiu | A45D 29/14 132/75.6 |

FOREIGN PATENT DOCUMENTS

| | | | |
|---|---|---|---|
| CN | 204409929 | U | 6/2015 |
| CN | 205233768 | U | 5/2016 |
| CN | 207519800 | U | 6/2018 |

* cited by examiner

FIVE-IN-ONE POLISHING HEAD

CROSS REFERENCE TO RELATED PATENT APPLICATION

The present application is the US national stage of PCT/CN2019/075809 filed on Feb. 22, 2019, which application is incorporated herein by reference.

BACKGROUND

Technical Field

The present invention relates to a polishing head for a nail polisher in the beauty industry, in particular to a five-in-one polishing head.

Related Art

Along with entering a new era, people's daily life is increasingly good, the beauty industry also tends to develop rapidly, the demand for beauty products is also increasing, and manicure is not exceptional. In order to achieve better shaping effects and convenience, the existing nail polishing head cannot meet the demand of the market along with the increase of manicure shapes and styles, and colleagues in the industry also continuously strive to meet the requirements of nail polishing.

In the Chinese patent CN207411734U, a nail polisher was disclosed on May 29, 2018, including a polisher body, a polishing head, a polishing head box, a power supply, a speed regulator, a hose with a dust collector at the end, a rod piece, an adapter, etc. Although the present invention solves the problem about powder handling during the polishing process of a nail polisher, the polishing head is sharp and there is a risk of scratching nails when the nails contact the polishing head.

The inventor of the present invention recorded a previous technical innovation activity in the Chinese patent CN207519802U. In this patent, another style of ceramic nail polishing head capable of enhancing heat dissipation was disclosed on Jun. 22, 2018. A blade portion of a polishing head is made of a zirconia ceramic material, and is provided with an axial through hole capable of enhancing heat dissipation and facilitating heat conduction. The blade portion is a cylinder, and both ends are provided with arc chamfers to avoid scratching nails.

However, due to the defect of the tooth shape design of the current nail polishing head, the polishing head can only polish unidirectionally to be suitable for right-hand operators and cannot polish bidirectionally, so that it is difficult for those left-handed nail technicians. In addition, one polishing head has only one tooth density, so that a nail technician needs to continuously change the polishing head when working, the use of the nail polishing head is time-consuming and labor-consuming, the working efficiency is reduced, the attractiveness of polished nails is reduced, and the manufacturing cost of manicure operation is increased.

The known nail polishing heads therefore suffer from the above inconveniences and problems.

SUMMARY

An objective of the present invention is to provide a structurally-novel and multi-functional five-in-one polishing head.

In order to achieve the objective, the present invention adopts the following technical solutions:

A five-in-one polishing head has five polishing functions: angle tooth polishing, thin tooth polishing, medium-thin tooth polishing, thick tooth polishing, and bidirectional polishing, is applicable to a nail polisher, and includes a blade portion and a handle portion.

The blade portion is made of a tungsten steel material or a zirconia ceramic material, and is shaped like a cone having a concave or planar top cross section, angle teeth, thin teeth, medium-thin teeth, and thick teeth are sequentially distributed in a conical polishing head according to the tooth density, the angle teeth are located at the top of the conical polishing head in a circle, the thick teeth are located at the end of the blade portion, and the length of the blade portion is greater than or equal to 15.5 mm.

The handle portion is made of a tungsten steel material, and is shaped like a cylinder having a diameter of 2.35 mm and a length greater than or equal to 25.4 mm.

The center of the end of the blade portion is axially welded and fixed to one end of the handle portion, the conical polishing head is provided with regularly distributed straight lines or oblique lines on a surface from the angle teeth to the thick teeth, the shape of a right-handed groove on the surface is inverted trapezoidal, and the shape of a left-handed groove is triangular.

The five-in-one polishing head of the present invention may be further implemented by adopting the following technical measures.

In the foregoing five-in-one polishing head, a total length of the conical polishing head is greater than or equal to 41 mm, a top cross-sectional diameter of the angle teeth is greater than or equal to 4.5 mm, and a bottom cross-sectional diameter of the thick teeth is greater than or equal to 7.0 mm.

In the foregoing five-in-one polishing head, an included angle between both sides of the groove is greater than or equal to 30°.

In the foregoing five-in-one polishing head, the angle teeth are R angles having a radius less than or equal to 0.5 mm.

In the foregoing five-in-one polishing head, a conical angle of the cone is 1-20°.

By adopting the above technical solution, the five-in-one polishing head of the present invention has the following advantages:

1. The polishing head is simple in structure and convenient to manufacture.

2. The polishing head may match a polisher to implement forward and reverse rotation polishing, so that left-hand and right-hand operations are met simultaneously. When the polishing head is used, four knives are replaced with one knife to avoid the wear of the polisher caused by a handle during knife changing.

3. The working efficiency is improved, the time of knife changing is shortened, and the entire manicure process may be completed by using one knife.

In the figures, 1, blade portion; 2, handle portion; 3, angle tooth; 4, thin tooth; 5, medium-thin tooth; 6, thick tooth; 7, concave surface.

DETAILED DESCRIPTION

The present invention is further described below with reference to embodiments and the accompanying drawings.

Embodiment 1

A five-in-one polishing head of the present invention has five polishing functions: angle tooth polishing, thin tooth polishing, medium-thin tooth polishing, thick tooth polishing, and bidirectional polishing, is applicable to a nail polisher, and includes a blade portion and a handle portion.

Figure 1:
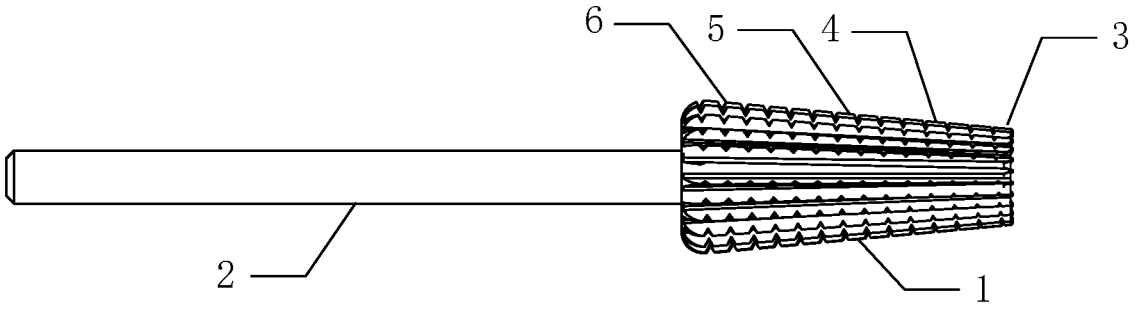
FIG. 1 is a schematic view showing a structure in which a conical polishing head is provided with regularly distributed straight lines on a surface from angle teeth to thick teeth according to an embodiment of the present invention.

Reference is now made to FIG. 1. FIG. 1 is a schematic view showing a structure in which a conical polishing head is provided with regularly distributed straight lines on a surface from angle teeth to thick teeth according to an embodiment of the present invention. As shown in the figure, a blade portion 1 is made of a tungsten steel material, and is shaped like a cone having a planar top end. Angle teeth 3, thin teeth 4, medium-thin teeth 5, and thick teeth 6 are sequentially distributed in a conical polishing head according to the tooth density. The angle teeth are located at the top of the conical polishing head in a circle. The thick teeth are located at the end of the blade portion. The length of the blade portion is 15.5 mm.

A handle portion 2 is made of a tungsten steel material, and is shaped like a cylinder having a diameter of 2.35 mm and a length of 25.4 mm. The center of the end of the blade portion is axially welded and fixed to one end of the handle portion. The conical polishing head is provided with regularly distributed straight lines or oblique lines on a surface from the angle teeth to the thick teeth. The shape of a right-handed groove on the surface is inverted trapezoidal, and the shape of a left-handed groove is triangular. An included angle between both sides of the groove is 30°. A total length of the conical polishing head is 41 mm. A top diameter of the angle teeth is 4.5 mm, and a bottom diameter of the thick teeth is 7.0 mm. The entire polishing head surface is smoothly transited. The shape of the angle teeth is an R angle having a size of R0.5. A conical angle of the cone is 20°. The angle teeth of the polishing head in the present embodiment have better affinity for nails and skin.

Embodiment 2

The present embodiment is the same as Embodiment 1 except that the blade portion 1 is made of a zirconia ceramic material and is shaped like a cone having a concave top end. The polishing head in the present embodiment has the function of enhancing heat dissipation.

Embodiment 3

Figure 2:
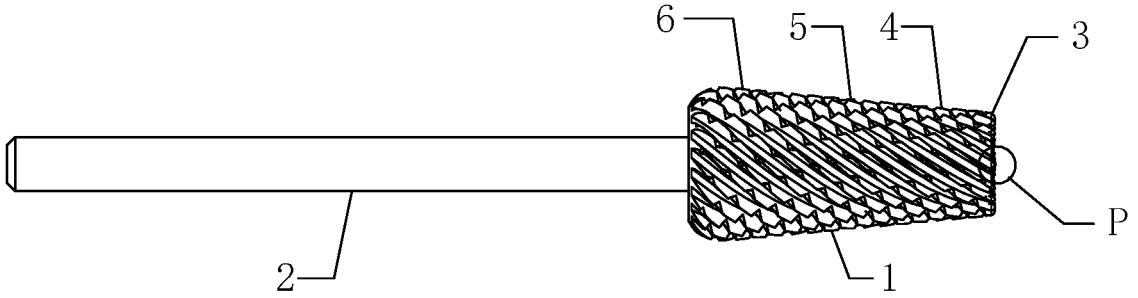
FIG. 2 is a schematic view showing a structure in which a conical polishing head is provided with regularly distributed oblique lines on a surface from angle teeth to thick teeth according to an embodiment of the present invention.
Figure 3:
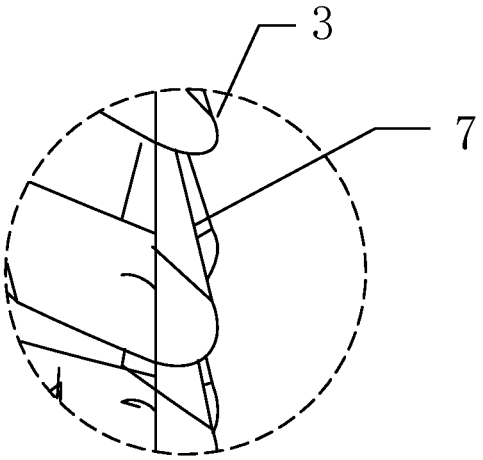
FIG. 3 is an enlarged view of part P in FIG. 2.

In the present embodiment, the conical polishing head has an oblique line structure. FIG. 2 is a schematic view showing a structure in which a conical polishing head is provided with regularly distributed oblique lines on a surface from angle teeth to thick teeth according to an embodiment of the present invention. FIG. 3 is an enlarged view of part P in FIG. 2. The top end of the cone is a concave surface 7, so that nail grooves may be finely operated, and nail surface layers are more exquisite.

The present invention has substantial characteristics and remarkable technical progress. The five-in-one polishing head of the present invention is conical. A commonly used polishing head for exfoliation is a tool having an outer diameter of 1.6 mm. When the five-in-one polishing head is used, only an arc surface of a ball head corner contacts the skin, the contact area between the tool and the skin is small, and dead skin is not removed cleanly. The angle teeth R0.5 of the five-in-one polishing head may completely contact the skin for polishing, and the dead skin may be removed more thoroughly. The function of the angle teeth is to remove the dead skin at the edges of nails, the function of the thin teeth and the medium-thin teeth is to remove nail polish, and the function of the thick teeth is to remove the nail polish of the phototherapy nails. The five-in-one polishing head of the present invention may complete the entire manicure process with one knife.

The above embodiments illustrate rather than limit the present invention, and those skilled in the relevant art will be able to make various transformations or changes without departing from the spirit and scope of the present invention. Accordingly, it is intended that all equivalent technical solutions fall within the scope of the present invention as defined by the claims.

What is claimed is:

1. A five-in-one nail polishing head comprising:

a handle portion;

a blade portion attached to the handle portion, the blade portion comprising:

an angled tooth polishing portion, a thin tooth polishing portion, a medium thin tooth polishing portion, a thick tooth polishing portion, and a bidirectional polishing portion, thereby forming five polishing functions of the blade portion;

wherein the blade portion is made of a tungsten steel material or a zirconia ceramic material;

wherein the blade portion is shaped like a cone having a concave or a planar top end;

wherein the angled tooth portion includes angled teeth, the thin tooth portion includes thin teeth, the medium-thin tooth portion includes medium-thin teeth, and the thick tooth portion includes thick teeth;

wherein the angled teeth, thin teeth, medium-thin teeth, and thick teeth are sequentially distributed on the cone-shaped blade portion according to tooth density;

wherein the angled teeth are located at the top end of the cone-shaped blade portion in a circle and the thick teeth are located on an opposite bottom end of the blade portion and a length of the blade portion is greater than or equal to 15.5 mm;

wherein the handle portion is made of a tungsten steel material and is shaped like a cylinder having a diameter of 2.35 mm and a length greater than or equal to 25.4 mm;

wherein a center of the opposite bottom end of the blade portion is axially welded and fixed to an end of the handle portion;

wherein the bidirectional polishing portion is provided with regularly distributed straight lines or oblique lines on a surface of the cone shaped blade portion extending from the angled teeth to the thick teeth and wherein the lines form at least one right-handed groove on the exterior surface that is an inverted trapezoidal shape and at least one left-handed groove on the exterior surface that is a triangular shape.

2. The five-in-one polishing head according to claim 1, wherein the length of the cone-shaped blade is greater than or equal to 41 mm, a top cross-sectional diameter of the angled teeth is greater than or equal to 4.5 mm, and a bottom cross-sectional diameter of the thick teeth is greater than or equal to 7.0 mm.

3. The five-in-one polishing head according to claim 1, wherein an included angle between the right-handed groove and the left-handed groove is greater than or equal to 30°.

4. The five-in-one polishing head according to claim 1, wherein a conical angle of the cone is 1-20°.

* * * * *